US005398523A

United States Patent [19]

Yoshii et al.

[11] Patent Number: 5,398,523

[45] Date of Patent: Mar. 21, 1995

[54] RECEIVER DRYER FOR A REFRIGERATION CIRCUIT

[75] Inventors: Yasuo Yoshii, Takasaki; Toshiyuki Kawai, Maebashi, both of Japan

[73] Assignee: Sanden Corporation, Isesak, Japan

[21] Appl. No.: 107,029

[22] Filed: Aug. 17, 1993

Related U.S. Application Data

[63] Continuation of Ser. No. 801,653, Dec. 2, 1991.

[30] Foreign Application Priority Data

Nov. 30, 1990 [JP] Japan ..... 2-128838 U

[51] Int. Cl.[6] ..... F25B 43/00

[52] U.S. Cl. ..... 62/474; 62/475; 62/509

[58] Field of Search ..... 62/474, 475, 503, 509

[56] References Cited

U.S. PATENT DOCUMENTS

| | | | |
|---|---|---|---|
| 2,835,114 | 5/1958 | Shoemaker | 62/474 |
| 3,765,192 | 10/1973 | Root | 62/509 X |
| 3,785,164 | 1/1974 | Wrenn et al. . | |
| 4,331,001 | 5/1982 | Jones | 62/474 X |
| 4,577,469 | 3/1986 | Okura | 62/509 X |
| 4,649,719 | 3/1987 | Yanagisawa . | |
| 4,698,985 | 10/1987 | Wintersteen | 62/474 |
| 4,707,999 | 11/1987 | Ohta et al. | 62/509 X |
| 4,756,166 | 6/1988 | Tomasov | 62/474 X |
| 4,788,833 | 12/1988 | Steele | 62/474 |
| 4,800,737 | 1/1989 | Smith et al. | 62/474 X |
| 4,934,552 | 6/1990 | Koide et al. | 62/509 X |
| 4,993,455 | 2/1991 | Yanagisawa . | |
| 5,038,582 | 8/1991 | Takamatsu | 62/474 |

FOREIGN PATENT DOCUMENTS

| | | | |
|---|---|---|---|
| 188319 | 1/1957 | Austria . | |
| 214949 | 5/1961 | Austria | 62/509 |
| 104750 | 4/1984 | European Pat. Off. | 62/474 |
| 1501059 | 9/1969 | Germany | 62/474 |
| 2540032 | 3/1977 | Germany | 62/509 |
| 315874 | 12/1988 | Japan . | |
| 478982 | 2/1976 | U.S.S.R. | 62/474 |
| 714109 | 2/1980 | U.S.S.R. | 62/509 |
| 1017199 | 5/1983 | U.S.S.R. | 62/50.5 |

*Primary Examiner*—Christopher Kilner
*Attorney, Agent, or Firm*—Baker & Botts

[57] ABSTRACT

The receiver dryer includes a cylindrical body with fluid inlet and outlet ports that allow fluid communication between the interior of the body and the refrigeration circuit. The body includes a concave section. The concave section extends downwardly of the bottom portion of the body. A fluid outlet pipe extends into the interior of the concave portion. Therefore, the receiver dryer can reduce the refrigerant volume in the refrigeration circuit without decrease of the refrigerating capacity, since the receiver dryer promotes separation of liquid and gaseous refrigerant. Thus, the receiver dryer can be made compact.

20 Claims, 4 Drawing Sheets

RECEIVER DRYER FOR A REFRIGERATION CIRCUIT

This application is a continuation of application Ser. No. 07/801,653, filed Dec. 2, 1991.

TECHNICAL FIELD

The present invention relates to a receiver dryer for a refrigeration circuit, and more particularly, to a receiver dryer for a refrigeration circuit which can reduce the refrigerant volume therein without decreasing the refrigeration capacity.

BACKGROUND OF THE INVENTION

FIG. 1 illustrates the construction of a conventional receiver dryer for a refrigeration circuit. The typical refrigeration circuit includes a condenser, an evaporator, a receiver, a compressor and an expansion valve. These items are not shown since the construction and operation of such circuits are known to those of ordinary skill in the art.

As shown in FIG. 1, receiver dryer 10 includes cylindrical body 11 having upper and lower openings. Header 12 is disposed on the upper opening and welded thereto. End or bottom plate 15 is disposed on the lower opening and is also welded to body 11. Header 12 comprises cover plate 121 having a central opening through which connecting portion 122 extends, fluid inlet port member 123 and fluid outlet port member 124. Both fluid inlet and outlet port members 123, 124 are fixed to the central opening through connecting portion 122. Connecting portion 122 includes first and second tubular portions **122*a* and 122*b* which allow fluid communication between the interior of cylindrical body 11 and fluid inlet and outlet port members 123 and 124, respectively. Sight glass 13 is placed on the outer opening of second tubular portion 122*b* of connecting portion 122. Fluid outlet pipe 14 is fixed on the inner opening of second tubular portion 122*b*. Terminal end 141 of fluid outlet pipe 14 extends into the lower portion of the interior of cylindrical body 11**.

Cylindrical body 11 is sectionally divided into three chambers. Upper and lower chambers 111 and 112 are separated by central chamber 113. Central chamber 113 is defined by divider walls 161 and 162 which include a plurality of apertures. Filters **161*a* and 162*a* for removing dirt are respectively disposed on the inner surfaces of divided walls 161 and 162 to oppose each other. Desiccant 16 is disposed within central chamber 113** for removing water from the refrigerant.

When the above-mentioned receiver dryer is disposed within a refrigeration circuit, liquid refrigerant is introduced into upper chamber 111 through fluid inlet port member 123 and first tubular portion **122*a*. Liquid refrigerant in upper chamber 111 flows into central chamber 113 through the apertures of divider wall 161 and filter 161*a*. Dirt and other foreign particles are removed from the liquid refrigerant by filter 161*a*. Water is removed from liquid refrigerant by desiccant 16 contained in central chamber 113. Any remaining dirt or foreign particles are further removed from the liquid refrigerant by filter 162*a* as liquid refrigerant flows from central chamber 113 into lower chamber 112 through the apertures of divider wall 162 and filter 162*a*. Liquid refrigerant is stored in lower chamber 112** and separates into both gaseous and liquid phases.

Liquid refrigerant stored in lower chamber 112 is sucked out through terminal end 141 of fluid outlet pipe 14 and then flows to the refrigerant circuit through second tubular portion **122*b* and fluid outlet port member 124**.

As mentioned above, a receiver dryer operates to remove water, dirt and other foreign particles from the liquid refrigerant. Further, the receiver dryer separates the refrigerant into both gaseous and liquid phases. Changes in the volume of the discharged refrigerant based on changes in the heat load and the rotational speed of a compressor are also compensated for by the receiver dryer.

However, since bottom plate 15 of the receiver dryer is formed with a planar surface, several problems can occur. First, if the volume of the refrigerant stored in lower chamber 112 is small, terminal end 141 of fluid outlet pipe 14 may be positioned at the boundary between the liquid phase refrigerant and the gaseous phase refrigerant. Accordingly, fluid outlet pipe 14 would not only suck liquid refrigerant into the refrigeration circuit, but also gaseous refrigerant. Thus, the refrigerating capacity of the refrigeration circuit including the receiver dryer would thereby be reduced accordingly.

Second, refrigerant flows into lower chamber 112 from central chamber 113 in drops similar to raindrops. Therefore, when the drops of refrigerant fall into lower chamber 112, they cause waves and bubbles to occur in the liquid refrigerant contained in lower chamber 112. Under these conditions, gaseous and liquid refrigerant may easily flow into terminal end 141.

In the past, these problems have been overcome by increasing the volume of the refrigerant used. This thus prevents the occurrence of waves and bubbles in the refrigerant. However, the volume of the refrigerant cannot be reduced below a certain point. Thus, the size of the receiver dryer must be maintained relatively large compared to the refrigeration circuit.

SUMMARY OF THE INVENTION

It is an object of this invention to provide a receiver dryer for a refrigeration circuit so that the refrigerant volume can be reduced without decreasing the refrigerating capacity.

It is another object of this invention to provide a receiver dryer for a refrigeration circuit which will allow separation of liquid and gaseous phase refrigerant.

It is still another object of this invention to provide a receiver dryer which can be made compact for a given refrigeration circuit.

A receiver dryer for a refrigeration circuit according to the present invention includes a body with fluid inlet and outlet ports which allow fluid communication between the body interior and the refrigeration circuit. The body includes a bottom portion having a concave section. The concave section extends downwardly of the bottom portion of the body in certain defined ranges. The fluid outlet port is designed to extend into the interior of the concave section.

Further objects, features and advantages of this invention will be understood from the following detailed description of the preferred embodiments of this invention with reference to the attached drawings.

DETAILED DESCRIPTION OF THE PREFERRED EMBODIMENTS

Figure 1:
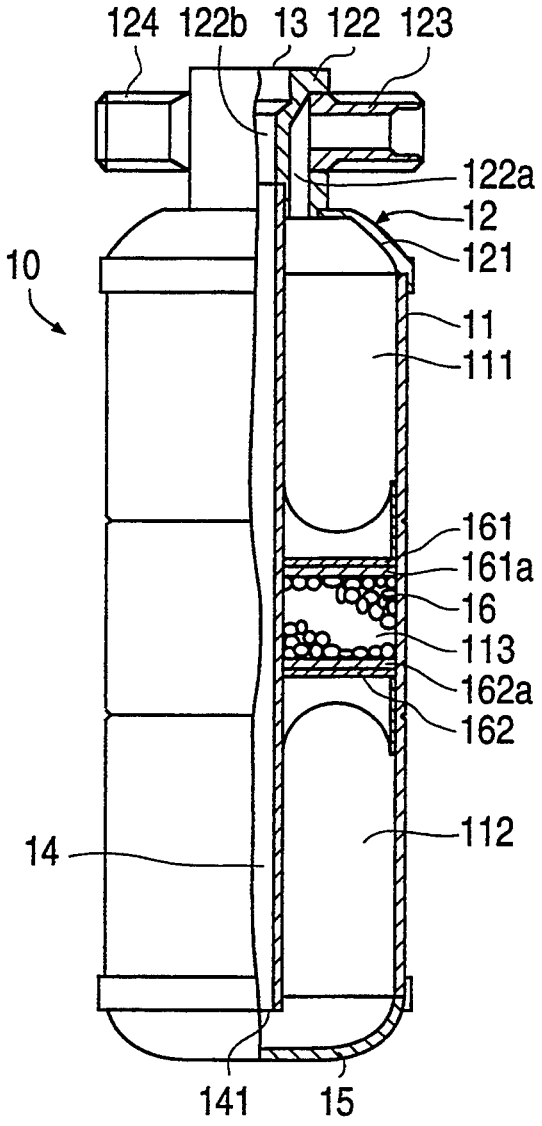
FIG. 1 PRIOR ART
FIG. 1 is a partly exploded front view of a conventional receiver dryer.
Figure 2:
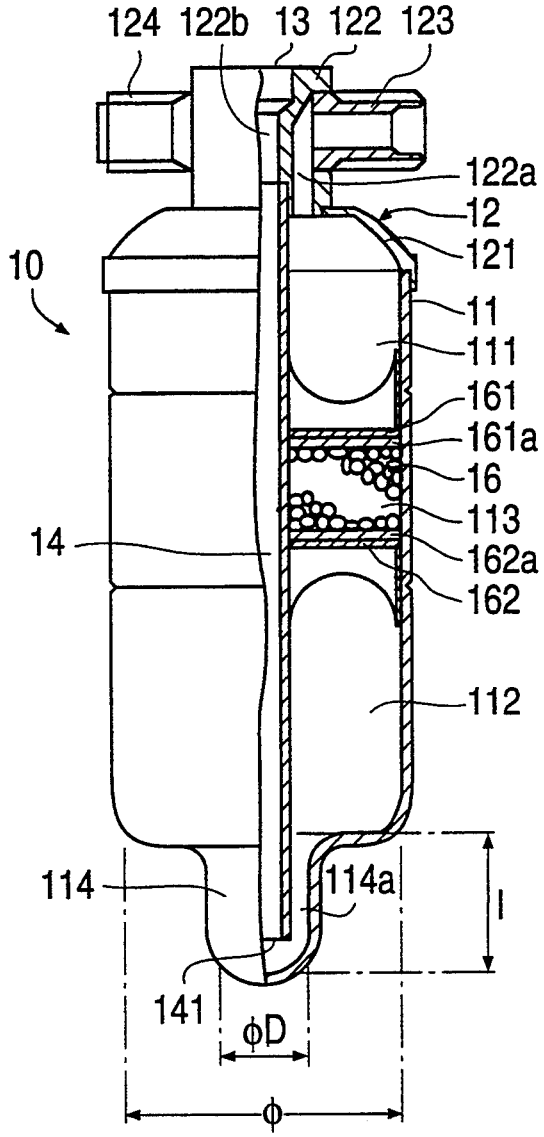
FIG. 2 is a partly exploded front view of a receiver dryer in accordance with one embodiment of this invention.

The construction of a receiver dryer in accordance with one embodiment of this invention is shown in FIG. 2. The same reference numerals are accorded on the same construction and parts as shown in FIG. 1.

Receiver dryer 10 includes cylindrical body 11 with an upper opening, and header 12 which is disposed on the upper opening and welded thereto. Header 12 comprises cover plate 121 having a central opening, connecting portion 122, fluid inlet port member 123 and fluid outlet port member 124 which is fixed in the central opening through connecting portion 122. Connecting portion 122 is provided with first and second tubular portions **122*a* and 122*b* which allow fluid communication between the interior of cylindrical body 11 and fluid inlet and outlet port members 123 and 124, respectively. Sight glass 13 is placed on the outer opening of second tubular portion 122*b* of connecting portion 122. Fluid outlet pipe 14 is fixed on the inner opening of second tubular portion 122*b*** at one end.

Cylindrical body 11 is sectionally divided into three chambers. Upper and lower chambers 111 and 112 are separated by central chamber 113. Central chamber 113 is defined by divider walls 161 and 162 which include a plurality of apertures. Filters **161*a* and 162*a* for removing dirt and other foreign particles are respectively disposed on the inner surfaces of divider walls 161 and 162 to oppose each other. Desiccant 16 for removing water of the refrigerant is disposed within central chamber 113**.

Lower chamber 112 is integrally formed with a concave section 114. Concave section 114 extends downwardly from lower chamber 112 and is axially aligned therewith. In this embodiment, concave section 114 is cylindrical in shape with a rounded or hemispherical closed end. Terminal end 141 of fluid outlet pipe 14 extends into the lower portion of the interior of concave section 114 through lower chamber 112.

Liquid refrigerant is introduced into upper chamber 111 from the refrigeration circuit through fluid inlet port member 123 and first tubular portion **122*a*. Liquid refrigerant in upper chamber 111 flows into central chamber 113 through the apertures of divider wall 161 and filter 161*a*. Dirt and other particles are removed from the liquid refrigerant by filter 161*a*. Water is removed from the liquid refrigerant by desiccant 16 contained in central chamber 113. Dirt and other particulates are further removed from the liquid refrigerant by filter 162*a* as the liquid refrigerant flows into lower chamber 112 through filter 162*a* and the apertures of divider wall 162. The liquid refrigerant further flows into concave section 114 through lower chamber 112. Liquid refrigerant collects at center 114a of concave section 114**.

Inner diameter $\phi$D of concave section 114 is less than inner diameter $\phi$ of cylindrical body 11, so that the refrigerant volume in the receiver dryer is less than the usual volume in a conventional receiver dryer. The liquid refrigerant level in concave section 114 can always be maintained higher than the position of terminal end 141 of fluid outlet pipe 14 so that only liquid refrigerant is introduced into the refrigeration circuit. Furthermore, waves and bubbles may occur in the refrigerant in concave section 114. However, since terminal end 141 of fluid outlet pipe 14 extends into the lower portion of concave section 114, terminal end 141 of fluid outlet pipe 14 can only suck liquid refrigerant therefrom.

As an example, if inner diameter $\phi$ of cylindrical body 11 is defined to be within the range of 45–120 mm, it is preferable that inner diameter $\phi$D of concave section 114 be equal to or less than depth I of concave section 114. Inner diameter $\phi$D is thus within the range of 15–30 mm, and depth I is within the range of 20–30 mm. Therefore, it is apparent that the inner diameter of the cylindrical body is between 1.5 and 8 times as large as the inner diameter of the concave section. Further, the length of the concave section is equal to or twice as long as the inner diameter of the concave section. The above dimensions have been shown to be satisfactory in alleviating the above enumerated problems.

Figure 3:
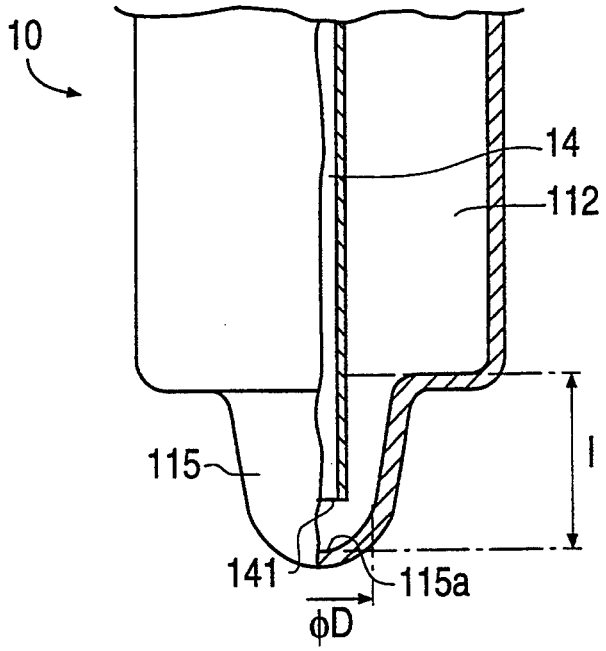
FIG. 3 is a partly exploded front view of a portion of a receiver dryer in accordance with another embodiment of this invention.
Figure 4:
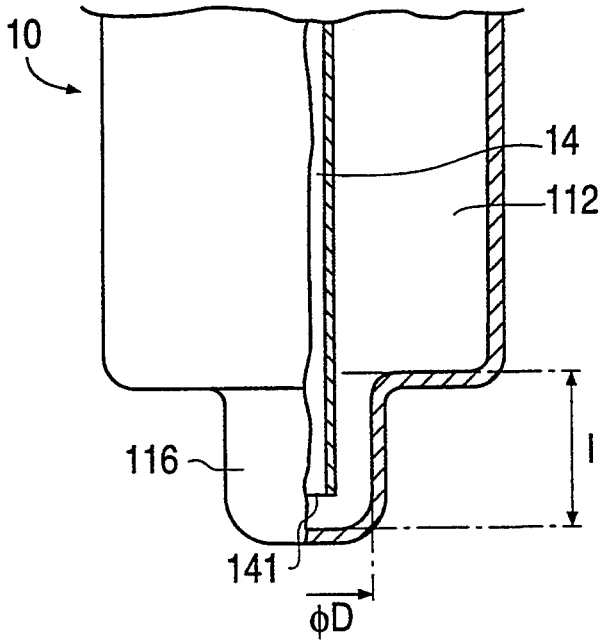
FIG. 4 is a partly exploded front view of a portion of a receiver dryer in accordance with still another embodiment of this invention.

FIGS. 3 and 4 illustrate other embodiments of the invention. Concave section 115 as shown in FIG. 3 is conical in shape, with a hemispherical center **115*a* at its closed end. Concave section 116 as shown in FIG. 4** is cylindrical with a planar closed end.

Figure 5:
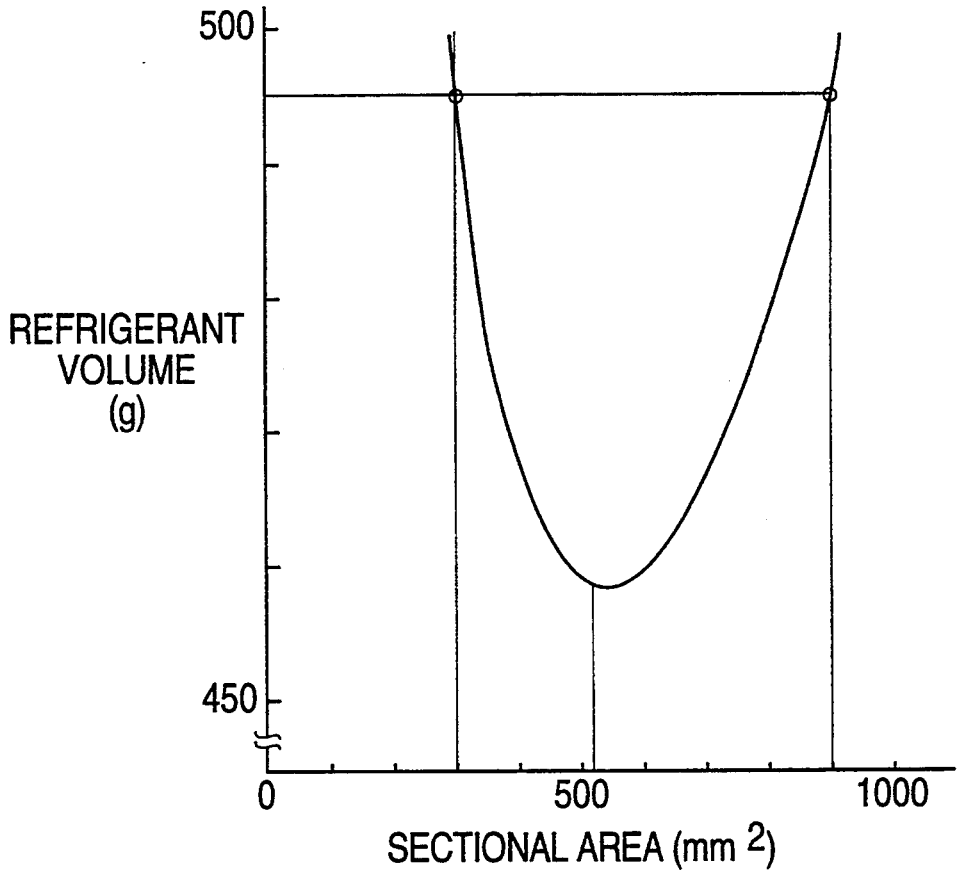
FIG. 5 is a graph showing the relationship between a sectional area of the concave section and a volume of refrigerant used in a refrigeration circuit.

FIG. 5 illustrates a graph showing the relationship between a sectional area of a concave section and the refrigerant volume used in the refrigeration circuit based on the data of an experiment. In this experiment, the shape of the bottom portion of the concave section is the same as shown in FIG. 4, i.e., the closed end of concave section 116 is planar. As shown in FIG. 5, the refrigerant volume used in the refrigeration circuit decreases as the sectional area approaches 510 $mm^2$, e.g., inner diameter $\phi$D of concave section 116 is about 20 mm and depth I is about 25 mm.

As the sectional area of concave section 116 decreases, it is necessary for the refrigerant volume in the refrigeration circuit to increase so that the influence of waves and bubbles in the refrigerant is avoided. If the sectional area decreases to less than 300 $mm^2$, then the refrigerant volume used in the refrigeration circuit must increase to greater than the volume used in conventional refrigeration circuits, i.e., about 495 g. Thus, no benefits are achieved. On the other hand, as the sectional area of concave section 116 increases, the liquid refrigerant level relative to terminal end 141 of fluid outlet pipe 14 becomes lower, and thus gaseous and liquid refrigerant may be introduced into the refrigeration circuit. If the sectional area becomes larger than 900 $mm^2$ the refrigerant volume used in the refrigeration circuit increases to greater than that used in the conventional refrigeration circuit.

Accordingly, if the dimensions of concave section 116 are defined as mentioned above, it becomes difficult for a mixture of gaseous and liquid refrigerant to be introduced into the refrigeration circuit. Separation between gas and liquid phase refrigerant is thus promoted. In addition, the volume of refrigerant used in the refrigeration circuit can be reduced. The same efficiency can be effected using any of the above shapes if the dimensions of the concave sections are defined as described above.

This invention has been described in detail in connection with several preferred embodiments. These embodiments, however, are merely for example only and the present invention is not restricted thereto. It will be understood by those skilled in the art that other variations and modifications can be easily made within the scope of this invention as defined in the appended claims.

We claim:

1. A receiver dryer for a refrigeration circuit comprising:

a hollow cylindrical body having fluid inlet and liquid outlet ports providing fluid communication between the interior of said cylindrical body and said refrigeration circuit;

a bottom portion closing one end of said cylindrical body;

a concave section attached to said bottom portion of said cylindrical body, said concave section forming a separate part of said bottom portion and extending downwardly therefrom and including a closed end; and a liquid outlet pipe connected directly to said outlet port, said liquid outlet pipe extending into the interior of said concave section.

2. The receiver dryer as recited in claim 1 wherein said cylindrical body has an inner diameter in the range of 45–120 mm and said concave section has an inner diameter in the range of 15–30 mm and a length in the range of 20–30 mm, whereby said concave section is formed, such that the length of said concave section is greater than or equal to the inner diameter of said concave section.

3. The receiver dryer as recited in claim 2 wherein said concave section is integrally formed with said cylindrical body.

4. The receiver dryer as recited in claim 3 wherein said concave section is cylindrical.

5. The receiver dryer as recited in claim 4 wherein said closed end is a hemispherical bottom portion.

6. The receiver dryer as recited in claim 4 wherein said closed end is a planar bottom portion.

7. The receiver dryer as recited in claim 3 wherein said concave section is conical.

8. The receiver dryer as recited in claim 7 wherein said closed end is a hemispherical bottom portion.

9. The receiver dryer as recited in claim 2 wherein said concave section is cylindrical.

10. The receiver dryer as recited in claim 9 wherein said closed end is a hemispherical bottom portion.

11. The receiver dryer as recited in claim 9 wherein said closed end is a planar bottom portion.

12. The receiver dryer as recited in claim 2 wherein said concave section is conical.

13. The receiver dryer as recited in claim 12 wherein said closed end is a hemispherical bottom portion.

14. In a refrigeration circuit, a receiver dryer comprising:

a hollow cylindrical body having an inner diameter;

a header attached to one end of said cylindrical body, said header having an inlet port and an outlet port;

a concave section, attached to the other end of said cylindrical body, having a given inner diameter and a given length and including a closed end;

a liquid outlet pipe attached directly to said outlet port and extending into said concave section; and wherein said cylindrical body inner diameter is between 3 and 8 times as large as the inner diameter of said concave section, and the length of said concave section is greater than the inner diameter of said concave section.

15. The receiver dryer as recited in claim 14 wherein the length of said concave section is equal to or twice as long as the inner diameter of said concave section.

16. The receiver dryer as recited in claim 14 wherein said concave section is cylindrical.

17. The receiver dryer as recited in claim 14 wherein said concave section is conical.

18. The receiver dryer as recited in claim 16 wherein said closed end is a hemispherical bottom portion.

19. The receiver dryer as recited in claim 17 wherein said closed end is a hemispherical bottom portion.

20. The receiver dryer as recited in claim 16 wherein said closed end is a planar bottom portion.

* * * * *